US010723426B2

(12) United States Patent
Borel et al.

(10) Patent No.: US 10,723,426 B2
(45) Date of Patent: Jul. 28, 2020

(54) MARINE VEHICLE THRUSTER CONTROL METHOD

(71) Applicant: THALES, Courbevoie (FR)

(72) Inventors: Christophe Borel, Sophia Antipolis (FR); Jean-Philippe Brunet, Sophia Antipolis (FR); Benoît Theckes, Sophia Antipolis (FR); Cyril Bouyer, Sophia Antipolis (FR)

(73) Assignee: THALES, Courbevoie (FR)

( * ) Notice: Subject to any disclaimer, the term of this patent is extended or adjusted under 35 U.S.C. 154(b) by 178 days.

(21) Appl. No.: 16/065,797

(22) PCT Filed: Dec. 22, 2016

(86) PCT No.: PCT/EP2016/082505
§ 371 (c)(1),
(2) Date: Jun. 23, 2018

(87) PCT Pub. No.: WO2017/109148
PCT Pub. Date: Jun. 29, 2017

(65) Prior Publication Data

US 2019/0009871 A1 Jan. 10, 2019

(30) Foreign Application Priority Data

Dec. 23, 2015 (FR) ..... 15 02683

(51) Int. Cl.

| | |
|---|---|
| ***B63G 8/16*** | (2006.01) |
| ***B63H 5/10*** | (2006.01) |
| ***B63H 3/00*** | (2006.01) |
| ***B63G 8/08*** | (2006.01) |
| ***B63H 25/42*** | (2006.01) |

(52) U.S. Cl.
CPC ..... *B63G 8/16* (2013.01); *B63G 8/08* (2013.01); *B63H 3/002* (2013.01); *B63H 5/10* (2013.01); *B63H 2025/425* (2013.01)

(58) Field of Classification Search
CPC . B63G 8/08; B63G 8/16; B63H 3/002; B63H 5/10; B63H 2025/425
See application file for complete search history.

(56) References Cited

U.S. PATENT DOCUMENTS

| | | | | |
|---|---|---|---|---|
| 3,101,066 | A | 8/1963 | Haselton | |
| 8,919,274 | B1 * | 12/2014 | Chen | B63G 8/08 114/330 |
| 9,022,738 | B1 * | 5/2015 | Silberg | B63G 8/001 416/141 |

FOREIGN PATENT DOCUMENTS

| | | | |
|---|---|---|---|
| EP | 0 117 881 | A1 | 9/1984 |
| EP | 0 215 629 | A2 | 3/1987 |
| EP | 0 732 261 | A1 | 9/1996 |

(Continued)

*Primary Examiner* — Aaron L Troost
(74) *Attorney, Agent, or Firm* — Baker & Hostetler LLP

(57) ABSTRACT

A method controlling a thruster of a marine vehicle is provided. The marine vehicle is at least partially submerged in a liquid and includes a body and a thruster including two propellers. Each propeller includes blades intended to tum about a rotation axis of said propeller. The method includes a step of low-speed maneuver controlling, during which the thruster is controlled in such a way that each propeller generates a flow directed toward the flow generated by the other propeller and reaching the flow generated by the other propeller.

18 Claims, 3 Drawing Sheets

(56) References Cited

FOREIGN PATENT DOCUMENTS

| | | | |
|---|---|---|---|
| EP | 1 466 826 | A2 | 10/2004 |
| WO | 2004/089740 | A1 | 10/2004 |

* cited by examiner

MARINE VEHICLE THRUSTER CONTROL METHOD

CROSS-REFERENCE TO RELATED APPLICATIONS

This application is a National Stage of International patent application PCT/EP2016/082505, filed on Dec. 22, 2016, which claims priority to foreign French patent application No. FR 1502683, filed on Dec. 23, 2015, the disclosures of which are incorporated by reference in their entirety.

FIELD OF THE INVENTION

The present invention pertains to the propulsion and to the maneuvering of marine vehicles comprising a thruster comprising two propellers.

BACKGROUND

The invention applies most particularly to underwater vehicles comprising a vectored thruster with two propellers. A thruster is termed vectored when it can be controlled so as to produce a thrust or propulsion force orientable over $4\pi$ steradians. So-called vectored propulsion of an underwater vehicle is opposed to conventional propulsion in which the orientation of control surfaces brings about a modification of the lift generated by the flow of fluid surrounding the control surfaces. The force generated by the fluid on the control surfaces makes it possible to orient the vehicle in the sought-after direction. A well-known limit of this form of propulsion is the need to generate an appreciable fluid flow around the vehicle in order to bring about an alteration in lift of the control surfaces allowing a change of attitude of the vehicle, that is to say in order to make it possible to maneuver the underwater vehicle. If this flow is too weak then the effectiveness of the control surfaces decreases inversely as the square of the speed of the flow until it becomes zero for a zero flow speed. Stated otherwise, it is not possible by conventional propulsion to orient the vehicle in a sought-after direction without an appreciable displacement of the vehicle, when the fluid flow is zero. Moreover the control surfaces generate a drag proportional to the square of the speed which opposes the displacement and which therefore consumes energy, the more so the more the control surfaces are invoked. The method for controlling a vectored propulsion presented in the present patent allows the vehicle to do away with conventional (rudder) control surfaces, and therefore makes it possible to appreciably reduce the hydrodynamic drag of the vehicle. Vectored propulsion of the type with two propellers presents numerous theoretical advantages, notably enhanced mobility, simplification of the architecture (e.g. by dispensing with the control surfaces), increase in the endurance of the vehicle (by reducing the hydrodynamic drag). This absence of any control surface other than the blades of the propellers facilitates the realization of a so-called "flush" hydrodynamic vehicle, that is to say from which no appendage protrudes, thereby allowing it for example to fit easily in a tube and avoiding damaging the control surfaces when docking alongside.

However, the controlling of a thruster with two propellers encounters numerous difficulties notably at low speed.

SUMMARY OF THE INVENTION

An aim of the invention is to propose a method for controlling a thruster with two propellers making it possible to maneuver the vehicle in an effective and stable manner at low speed.

For this purpose the subject of the invention is a method for controlling a thruster of a marine vehicle at least partially submerged in a liquid comprising a body and the thruster mounted on said body, the thruster comprising two propellers, each propeller comprising blades intended to turn about a rotation axis of said propeller. According to the invention, the method comprises a step of low-speed maneuver controlling, during which the thruster is controlled in such a way that each propeller generates a flow directed toward the flow generated by the other propeller and reaching the flow generated by the other propeller.

The method according to the invention advantageously presents at least one of the following characteristics taken alone or in combination:

each propeller generates a non-zero flow which is directed in the same sense, along the axis of the propeller, over the essential portion of the revolution of the blades of the propeller, in the liquid about the rotation axis of the propeller, at least one propeller generates a flow whose sense, along the x axis, varies over the revolution of the blades of the propeller in the liquid about the rotation axis of the propeller, during the step of low-speed maneuver controlling, the flow generated by each propeller is directed toward a point of the other propeller, called center of the other propeller, situated substantially on the rotation axis of the other propeller, during the step of low-speed maneuver controlling the thruster is controlled in such a way that each propeller generates a flow directed toward the flow generated by the other propeller and reaching the flow generated by the other propeller whatever the motion imparted to the vehicle by the thruster, the distance between the propellers lies between a non-zero threshold distance and triple the diameter of the larger of the two propellers, the distance between the propellers is greater than or equal to 20% of the diameter of the smaller of the two propellers, the step of low-speed maneuver controlling is implemented only when the flows generated by the two propellers meet between the two propellers some distance from the two propellers, the step of low-speed maneuver controlling is implemented whatever the motion of the vehicle on condition that the flows generated by the two propellers meet between the two propellers some distance from the two propellers, the two propellers comprise an upstream propeller and a downstream propeller along a reference axis in a predetermined sense, and in which during the step of low-speed maneuver controlling, in order that the thruster exerts a thrust exhibiting a non-zero component along the reference axis and in said sense, the thruster is controlled in such a way that the upstream thrust force resulting from the upstream flow generated by the upstream propeller exhibits an axial component of greater intensity than that of the axial component of the downstream thrust force resulting from the downstream flow generated by the downstream propeller, during the step of low-speed maneuver controlling, in order that the thruster generates a thrust force exhibiting a zero radial component along a radial axis lying in a plane perpendicular to a reference axis, the thruster is controlled in such a way that the combined flow resulting from the combination of the flows generated by the two propellers, between the two propellers, has symmetry of revolution about the reference axis, during the step of low-speed maneuver controlling, in order that the thruster exerts a thrust force exhibiting a non-zero radial component along a radial axis lying in a plane perpendicular to the reference axis, the thruster is controlled in such a way that the combined flow resulting from the combination of the flows generated by the two propellers between the two propellers does not have symmetry of revolution about the reference axis, during the step of low-speed maneuver controlling, in order that the thruster exerts a thrust force exhibiting a non-zero radial component, the thruster is controlled in such a way that at least one propeller generates a flow which does not have symmetry of revolution about the reference axis, during the step of low-speed maneuver controlling, in order that the vehicle turns about an axis perpendicular to the reference axis, the thruster is controlled in such a way that the thrust force generated by the thruster is applied at a point remote from the center of mass of the vehicle, during the step of low-speed maneuver controlling, in order that the vehicle translates along an axis perpendicular to the reference axis, the thruster is controlled in such a way that the thrust force generated by the thruster is applied at the center of mass of the vehicle, the thruster is a thruster comprising two variable collective and cyclic pitch counter-rotating propellers, a reference axis being an axis of the propellers which is an axis joining centers of the two propellers which are points lying on the rotation axes of the respective propellers, the rotation axes of the two propellers substantially coincide and coincide with the reference axis, during the step of low-speed maneuver controlling, in order that the thruster generates a thrust exhibiting a radial component exerted in a radial direction forming, about the reference axis, a first angle a with a reference direction, the cyclic pitches of the propellers are adjusted in such a way that the cyclic angle θ of the propellers is given by the following formula or in such a way that the cyclic angle θ of one of the two propellers is given substantially by the following formula, the other propeller exhibiting a neutral cyclic pitch:

$$\theta=\alpha-\varphi$$

where the cyclic phase φ is the angle formed, about the reference axis, between the thrust generated by the propellers and the cyclic angle θ of the propellers or respectively of one of the propellers, the cyclic phase φ being predetermined, the cyclic angle of a propeller being the angle formed about the reference axis between the direction in which the cyclic feathering angle of the propeller is maximal and the reference direction.

The invention also pertains to a marine vehicle intended to be at least partially submerged in a liquid comprising a body and a thruster comprising two propellers, each propeller comprising blades intended to turn about a rotation axis of said propeller, characterized in that it comprises a control device configured to be able to implement the method according to the invention, the control device comprising a control member which receiving a setting for implementing the step of low-speed maneuver controlling is configured to calculate a low-speed configuration so that each propeller generates a flow directed toward the flow generated by the other propeller and reaching the flow generated by the other propeller, the control device furthermore comprising an actuation device configured to control the thruster so as to place it in said low-speed configuration.

Advantageously, the setting for implementing the step of low-speed maneuver controlling comprises a thrust setting, the thruster calculating a low-speed configuration of the thruster such that the thruster generates a thrust in the direction of the thrust setting.

The invention also pertains to the control device and to a propulsion system comprising the control device and the thruster.

The method of controlling makes it possible to control the underwater vehicle in a stable and effective manner at low speed even when the speed of the vehicle is negative or zero and when the mass of the vehicle is significant. That is to say that this solution allows the vehicle to be maneuvering even at a fixed point or in reverse. It allows precise control of the attitude and of the position of the underwater vehicle with respect to a fixed frame of reference.

BRIEF DESCRIPTION OF THE DRAWINGS

Other characteristics and advantages of the invention will become apparent on reading the detailed description which follows, given by way of nonlimiting example and with reference to the appended drawings in which.

DETAILED DESCRIPTION

Figure 1:
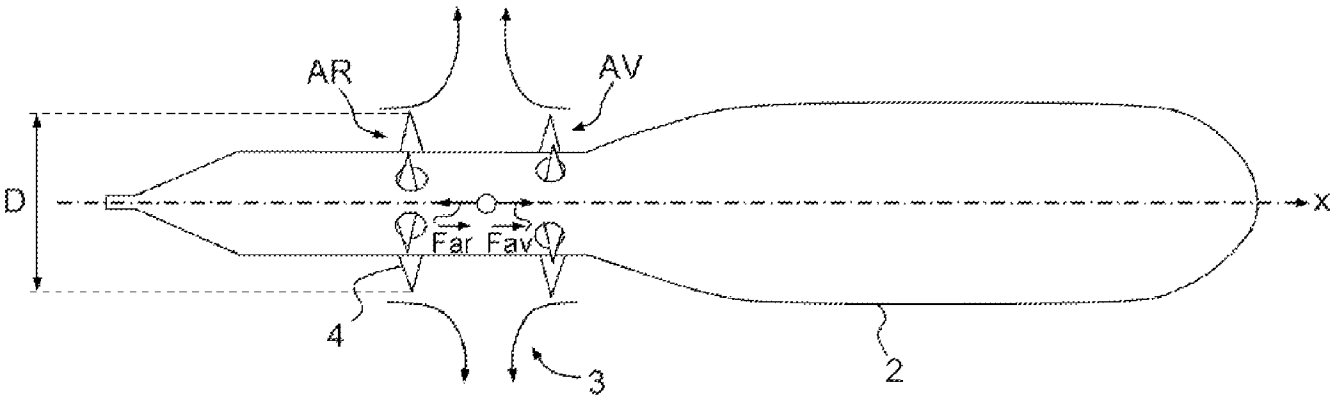
FIG. 1 schematically represents, viewed from above, an underwater vehicle at equilibrium.

From one figure to the other, the same elements are labeled with the same references.

The invention proposes a method for controlling a thruster of a marine vehicle. The method applies most particularly to underwater vehicles intended to move wholly submerged in a liquid, notably water. The invention also applies to surface vehicles intended to move on the surface of a liquid while being partially submerged in the liquid. Marine vehicles may be autonomous vehicles with (human) pilots on board, or drones with no pilot on board such as remotely controlled vehicles or ROVs (the acronym standing for "Remotely Operated Vehicle") or autonomous marine vehicles such as Autonomous Underwater Vehicles or AUVs. Consequently, the method of controlling, that is to say of control, according to the invention may be implemented by an operator (pilot) on board or remotely or by an autonomous control device.

Advantageously, the two propellers are mounted on the body of the marine vehicle so as to be arranged or be able to be arranged in such a way that each propeller, taken from among these two propellers, can generate a flow of water (or more generally of liquid) directed toward the flow generated by the other propeller, taken from among the two propellers. These propellers are advantageously disposed in such a way that the flow generated by each propeller, taken from among the two propellers, whatever the speed of the vehicle with respect to the liquid along a reference axis, at least as long as this speed is below a predetermined speed threshold, can reach the flow generated by the other propeller, taken from among the two propellers. Advantageously, the flows must be able to reach one another in a time less than a predetermined reaction time. This reaction time is the acceptable reaction time for the maneuver. This makes it possible to guarantee the formation of the combined or radial flow.

This method applies to vehicles comprising a vectored thruster comprising two so-called variable collective and cyclic pitch counter-rotating propellers. A propeller with variable collective and cyclic pitch is a propeller whose feathering angle of the blades can be controlled in a collective manner making it possible to adjust the thrust along the rotation axis of the propeller. The collective pitch is defined by a collective feathering angle of the blades. Stated otherwise, all the blades exhibit the same collective feathering angle over the entire revolution of the blades about the rotation axis of the propeller. Recall that the feathering angle of the blades of a propeller is the angle formed between the chord of the blade and the plane of rotation of the propeller according to the chosen reference. The plane of rotation of the propeller is a plane of the propeller perpendicular to the rotation axis of the propeller. The feathering angle is also adjustable in a cyclic manner making it possible to orient the thrust perpendicularly to the rotation axis of the propeller. The cyclic feathering angle of the blades varies in a cyclic manner that is to say in the course of a revolution about the rotation axis of the propeller, as a function of the angular positions of the blades about the rotation axis of the propeller. The cyclic pitch is defined by a differential cyclic feathering angle during a revolution of the blades and also by a cyclic angle. The differential cyclic feathering angle is defined as the difference between the maximum cyclic feathering angle and the minimum cyclic feathering angle of a blade in the course of a revolution. The collective pitch is the mean cyclic feathering angle. The cyclic angle is the angle formed, about the rotation axis of the propeller, between the direction in which the feathering angle of the blades is maximal and a reference direction tied to the body of the vehicle. The feathering angle of the blades for which the propeller in rotation about its rotation axis exerts a zero thrust, according to its rotation axis, is called neutral collective pitch. The neutral cyclic pitch is that for which the blades exert a thrust whose component perpendicular to the rotation axis of the propeller is zero. Coordinated controlling of the two propellers makes it possible to control the orientation of the thrust over $4\pi$ steradians. Vectored thrusters formed of two coaxial counter-rotating propellers, that is to say whose rotation axes substantially coincide, are in particular known. Coaxial propellers whose rotation axes are substantially parallel to the axis of principal of displacement of the vehicle are for example known. The principal axis of displacement of the vehicle is the axis, tied to the body of the vehicle, along which the vehicle is principally intended to move. By axis tied to the body of the vehicle is meant that the orientation and the position of the body of the vehicle in a plane perpendicular to the axis are fixed. This type of thruster presents the advantage of being able to be controlled so as to exhibit good energy efficiency at high speed. Thus the two propellers generate a thrust naturally oriented along the principal axis of displacement of the vehicle. In a conventional but nonlimiting manner, the principal axis of displacement of the vehicle is the roll axis of the vehicle. The yaw and pitch axes are radial axes, that is to say perpendicular to the principal axis, passing through the principal axis. The rotation axes of the propellers are fixed with respect to the vehicle.

The method is also applicable to thrusters of the type comprising two counter-rotating or non-counter-rotating propellers with variable cyclic and collective pitches for which the rotation axes of the propellers are distinct and substantially parallel and to those exhibiting propellers whose rotation axes are not parallel. Advantageously, for a vehicle intended to move principally along a principal axis, the rotation axes of the propellers form different arbitrary respective angles of 90° with this axis which is for example the principal axis of displacement of the vehicle. In a more advantageous manner, the rotation axes of the propellers are substantially parallel to the principal axis of displacement of the vehicle thereby making it possible to improve propulsion efficiency when progressing in a straight line along this axis. The rotation speed of the blades of the propeller about its rotation axis (called rotation speed of the propeller) can be adjusted independently or collectively for the two propellers.

The method according to the invention also applies to thrusters comprising two orientable thrusters with finger ball joint link, also called "gimbal propellers". These thrusters each exhibit a propeller comprising blades whose pitch is not adjustable. Each of the propellers is linked by a finger ball joint link to the body of the marine vehicle, carried out for example by means of a Gimbal mounting in such a way that the rotation plane (or the rotation axis) of each of the propellers can pivot, with respect to the body of the vehicle, about two mutually perpendicular axes. Stated otherwise, the orientation of the propellers with respect to the body of the vehicle is modifiable. The rotation speed of each of the propellers about its rotation axis is also adjustable, preferably, independently of one another. A single thruster of the "gimbal propeller" type exhibits more limited efficiency than the thrusters with variable collective and cyclic pitch counter-rotating propellers and exhibit action limited to a given angular aperture sector of less than 360°.

The propellers may exhibit the same diameter (as in the figures) or a different diameter, the same number of blades or a different number of blades.

In the subsequent description, a reference axis tied to the body of the vehicle is defined. By axis tied to the body of the vehicle is meant that the orientation and the position of the body of the vehicle in a plane perpendicular to the axis are fixed. An axis oriented perpendicular to the reference axis passing through this axis is called a radial axis and defines a radial direction. By radial component of a vector is meant the component of the vector along a radial axis perpendicular to the reference axis. By axial component of a vector is meant the component of the vector along the reference axis. In the present patent application, for a thrust, we define a radial thrust which is the radial component of the thrust and the axial thrust which is the axial component of the thrust.

The method of controlling according to the invention comprises a thruster controlling step called, hereinafter in the document, step of low-speed maneuver controlling.

According to the invention, the method comprises a step of low-speed maneuver controlling, that is to say control, during which the thruster is controlled, that is to say is controlled, in such a way that each propeller, from among the two propellers, generates a flow directed toward the flow generated by the other propeller, from among the two propellers, and reaching the flow generated by the other propeller. This assumes that the two propellers generate a water flow, that is to say turn with respect to the body of the marine vehicle about their respective propeller rotation axes, and have a non-neutral collective feathering angle. This makes it possible to generate a combined flow, arising from the combination of the flows generated by the two propellers, which exhibits a non-zero radial component and which makes it possible to control the vehicle in a stable manner and to obtain good maneuverability of the vehicle.

Moreover, in the realization of the figures, during the step of low-speed maneuver controlling, each propeller generates a non-zero flow which is directed in the same sense, along the rotation axis of the propeller, over the whole revolution of the blades of the propeller in the liquid about the rotation axis of the propeller. Stated otherwise, the axial component of the flow exhibits the same sign over the whole revolution of blades of the propeller in the liquid about the rotation axis of the propeller. This signifies that the flow lines generated by the propeller in each radial angular sector, fixed with respect to the body of the vehicle and swept by the propeller, are oriented in the same sense, along the rotation axis of the propeller. This makes it possible to generate a combined flow, arising from the combination of the flows generated by the two propellers, which exhibits a non-zero radial component right about the reference axis when the reference axis passes into the volume where the flows between the two propellers combine when the rotation axes of the propellers are not perpendicular to this reference axis.

The fact that each flow presents essentially the same sense over the entire revolution of the blades of the propeller in the liquid about the rotation axis makes it possible to avoid the creation of whirlpools between the propellers, the effect of which would be to destabilize the vehicle.

As a variant, at least one propeller generates a flow directed in a sense, along the rotation axis of the propeller, which varies over the revolution of the blades of the propeller in the liquid about the rotation axis of the propeller.

Advantageously, the propellers are mounted on the body of the marine vehicle so as to be arranged or be able to be arranged in such a way that each propeller can generate a flow of water (or more generally of liquid) directed toward the other propeller. In the present patent application, it is considered that one propeller generates a flow directed toward another propeller when the volume swept by the other propeller (during its rotation about the rotation axis) lies at least partially inside the cylinder whose axis is the principal axis of the flow generated by the propeller and whose diameter is the diameter of the propeller. Advantageously, the principal axis of the flow generated by each propeller passes into the volume swept by the other propeller during a revolution of the blades of the other propeller about the rotation axis of the other propeller. The direction of the principal axis is defined with respect to the body of the vehicle. The volume swept by a propeller comprises the rotation axis of the propeller. By principal axis of the flow generated by a propeller is meant the axis passing through a center of the propeller and whose direction is the direction of the flow generated by the propeller. By center of a propeller is meant a predetermined point of the propeller lying substantially on the rotation axis of the propeller and inside the volume that can be swept by the propeller during a revolution of the blades of the propeller about the rotation axis of the propeller. The center of a propeller can advantageously be defined as the center of mass of the blades. Advantageously, the planes of rotation of the propellers must be non-coplanar or must be able to be disposed in a non-coplanar manner. Advantageously, the flow directed by each of the two propellers is directed toward the center of the other propeller taken from among the two propellers. This is carried out so as to generate a thrust exhibiting no radial component. In this case, the direction of the flow generated by a propeller being defined by the principal axis of the flow, the principal axis of the flow generated by each propeller passes through said center of the other propeller. This makes it possible to avoid oscillations of the vehicle. The oscillations of the vehicle being all the more controlled the more the flow generated by one propeller is directed near the center of the other propeller. In this configuration the trajectory of the vehicle is more stable and easier to control since over a revolution of the blades of the propeller about the rotation axis of the propeller, all the blades encounter one and the same flow, notably when the flows of the propellers meet in proximity to one of the propellers. The feathering angle of the blades of the other propeller is therefore not disturbed by the flow generated by the propeller. If the flow is off-centered, not all the blades encounter a homogeneous flow. The feathering angle of the blades is therefore disturbed by the flow generated by the propeller.

Advantageously, the step of low-speed maneuver controlling is implemented whatever the motion imparted to the vehicle by the thruster when the modulus of the speed of the vehicle is less than a predetermined threshold that may possibly be zero. A vectored thruster can impart motions according to 6 degrees of freedom to an underwater vehicle. By the same method, the motion of a surface vessel can be adjusted by its thruster according to 2 translational degrees of freedom and 1 rotational degree of freedom.

Generally, the step of low-speed maneuver controlling can be implemented whatever the rotational motion about an axis perpendicular to the reference axis and/or whatever the translational motion along the reference axis and/or whatever the translational motion along an axis perpendicular to the reference axis imparted to the vehicle by the thruster. If this method is implemented when the modulus of the speed of the vehicle is greater than the predetermined threshold then the vehicle will slow down by itself through the simple fact of the application of the method to return to a speed below the threshold.

This method is illustrated by FIGS. 1 to 4 representing an underwater vehicle comprising a vectored thruster of the type with two counter-rotating propellers with variable cyclic and collective pitches. But what is described hereinafter is also applicable to surface vessels and to the other types of thrusters described previously.

FIGS. 1 to 4 schematically represent, viewed from above, an underwater vehicle 1 exhibiting a body 2 and a vectored thruster 3 mounted on the body of the underwater vehicle 1. This thruster 3 is of the vectored thruster type comprising two counter-rotating propellers AV, AR with variable cyclic and collective pitches. These propellers are coaxial. Stated otherwise, they are intended to turn about substantially coincident rotation axes. In these figures, the reference axis x is the axis of the propellers, that is to say the axis joining the centers of the two propellers. Moreover, this axis is the principal axis of displacement of the vehicle which is here the roll axis of the vehicle. The principal axis of displacement of the vehicle x is oriented in the favored sense of displacement of the vehicle when the vehicle exhibits a favored sense of displacement. In the present patent application, the front and the rear are defined with respect to the reference axis x in the sense of the reference axis. The propellers comprise a front propeller AV and a rear propeller AR, the front propeller being situated in front of the rear propeller. The blades of each propeller AV, AR are mounted on the body 2 of the vehicle 1 rotatably about the rotation axis of the corresponding propeller AV, AR. The blades of a propeller are bound in rotation about the rotation axis of the propeller. For example, each blade is linked by an axis to a hub mounted rotatably on the body 2 of the underwater vehicle 1 about the propeller's rotation axis generally defined by a shaft.

The water flow lines between the two propellers are represented by arrows. Recall that a flow generated by a propeller represents the speed of the water across the propeller. The modulus or intensity of the flow, expressed in $kg.m.s^{-1}$ is a momentum flowrate of the water across the surface of the propeller. The thrust forces generated by the respective propellers are also represented by single arrows. The thrust force generated by the thruster is represented, when it is not zero, by a double arrow. For more clarity, this arrow is represented on the rear of the vehicle but the thrust is advantageously applied between the two propellers on a point of the roll axis.

In the realization of the figures, the two propellers AV, AR are installed at the rear of the vehicle, that is to say on the rear half of the body of the vehicle along the reference axis x. As a variant, these two propellers are installed at the front of the body of the vehicle or one at the front and one at the rear of the body of the vehicle. To be able to turn the vehicle, that is to say to displace the vehicle by generating a thrust exhibiting a non-zero radial component (perpendicular to the x axis), the planes of rotation of the propellers are not disposed in mutually symmetric planes with respect to a plane containing the center of mass of the body 2 of the underwater craft 1.

In each of the situations represented in the figures, each propeller generates a flow directed toward the other propeller. Stated otherwise, the front propeller AV generates a flow toward the rear propeller AR which itself generates a flow directed toward the front propeller AV. Each flow exhibits a non-zero component of the same sign along the rotation axis of the propeller x, over the essential portion of the revolution of the blades of the corresponding propeller about the rotation axis of the propeller x, and preferably over the entire revolution of the blades of the propeller about the rotation axis of the propeller. Consequently, the flows generated by the two propellers meet and deviate one another all around the x axis. Stated otherwise, these flows combine to form between the propellers, some distance from the propellers, a flow called combined or radial flow as visible in the figures. In the realization of the figures, the combined flow exhibits globally a non-zero and positive radial component in each radial angular sector of a disk which is fixed with respect to the body 2 and perpendicular to the reference axis even when the vehicle is not moving. The combined flow recedes from the reference axis all around the reference axis. This makes it possible to obtain a thrust force which is balanced in all radial directions even when the vehicle is not moving along the axis of the propellers. The non-zero radial components of the combined flow make it possible to ensure effective radial maneuverability of the vehicle at zero speed along the reference axis and also at non-zero speed when the thruster produces a thrust to displace the vehicle axially. This makes it possible to maximize the thrust generated by the thruster. Indeed, the flows of the propellers being generated toward one another, the flow generated by each propeller cannot reach the other propeller, it is deviated by the flow generated by the other propeller. These flows do not aspirate one another, thereby maximizing the radial thrust effect. The reference axis is advantageously the axis of the propellers, the radial flow is then substantially centered on the rotation axis of the propellers.

The generation, by the two propellers of flows oriented toward one another and by reaction of the opposite thrusts, makes it possible to stabilize the vehicle and to properly control the maneuvering of the vehicle.

The vehicle controlled by means of the method according to the invention is quite insensitive to exterior disturbances. As already mentioned, because the flow generated by each propeller cannot reach the other propeller, the two propellers do not disturb one another. Stated otherwise, the flow generated by one propeller does not disturb the angle of incidence of the other propeller for a given feathering angle of the blades. The angle of incidence is defined with respect to the liquid flow which passes through it. Consequently, by creating the radial combined flow, when the cyclic pitch and the collective pitch of the propellers are thereafter adjusted in order to cause the vehicle to move forward, to reverse and/or to pivot, the vehicle is stabilized at a speed of displacement or of rotation with respect to the water depending solely on the adjustment of the propellers and if a disturbance which tends to slow down or accelerate the underwater craft is generated, this disturbance generates a variation of the water speed at the level of the propellers which gives rise to a variation of the angle of attack (or of incidence) of the blades of the propellers, thereby generating a thrust variation which opposes the motion of the exterior disturbance.

Moreover, good maneuverability and stability of the vehicle at low speed and at zero speed do not require the integration of additional maneuvering systems or of elements generating a hydrodynamic drag which is expensive in terms of energy particularly when the vehicle will want to move.

It should be noted that the method according to the invention is anti-intuitive since the generation of flows directed toward one another by the propellers consumes a great deal of energy, all the more so as these flows exhibit the same sign over the entire revolution of the volume swept by the blades of the propeller about rotation of the propeller.

The step of low-speed maneuver controlling is advantageously implemented to maneuver the vehicle about a fixed point.

We shall now describe more precisely the situations represented in each of the figures.

In FIG. 1, the vehicle is stationary. The flows generated by the two propellers are directed toward one another along the x axis. This signifies that each of these flows has symmetry of revolution about the x axis. Stated otherwise, they are homogeneous over the entire revolution of the blades of the respective propellers about the x axis. Moreover, the flows generated by the two propellers exhibit the same intensity. The front $\overrightarrow{Fav}$ and rear $\overrightarrow{Far}$ thrust forces resulting respectively from the front flow (generated by the front propeller toward the rear propeller) and from the rear flow (generated by the rear propeller toward the front propeller) therefore exhibit the same intensity. Consequently, the combined flow which arises from the deviation of the flows on account of these two flows meeting is radial, that is to say perpendicular to the x axis, and is so around the whole of the x axis. The combined flow exhibits a globally annular shape. The thruster generates a thrust force $\vec{F}$ whose axial component is zero. The position of the vehicle 1 in translation along the axial direction x with respect to a frame of reference remains fixed for example the liquid.

Consequently, in order that the vehicle does not move along the x axis of the propellers, the thruster 3 is controlled in such a way that the thrust forces resulting from the flows generated by the two propellers exhibit axial components of the same intensity (or modulus). Stated otherwise, the thruster is controlled in such a way that the flows generated by the two propellers exhibit the same modulus along the x axis and contrary senses along the x axis. This is carried out while the flows are being generated toward one another. The thruster does not generate any axial thrust. To achieve this, the cyclic pitches and/or the rotation speeds of the propellers are acted on.

In FIG. 1, the combined flow having symmetry of revolution about the x axis, the thruster generates a thrust force $\vec{F}$ whose radial component is zero. It is not possible to orient the vehicle by rotation about an axis perpendicular to the x axis in this configuration. To obtain this configuration, the combination of the rotation speed and of the collective feathering angle (also called collective pitch) of each propeller is such that the propeller generates a flow in the direction of the other propeller and resulting in a thrust equal and opposite to that generated by the other propeller.

Figure 2:
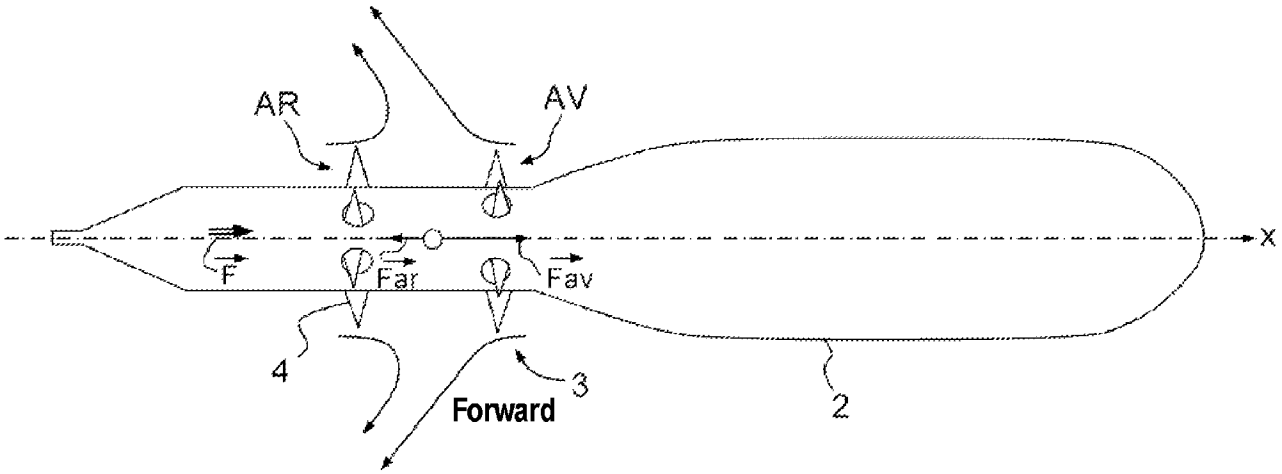
FIG. 2 schematically represents, viewed from above, an underwater vehicle moving frontward along the x axis, FIG. 3 schematically represents, viewed from above, an underwater vehicle moving rearward along the x axis, FIG. 4 schematically represents, viewed from above, an underwater vehicle on which the thruster exerts a non-zero radial thrust.

In FIG. 2, the flows generated by the two propellers are directed toward one another and along the x axis. Each of these flows has symmetry of revolution about the x axis. On the other hand, the front $\overrightarrow{Fav}$ and rear $\overrightarrow{Far}$ thrust forces resulting respectively from the front flow (generated by the front propeller AV toward the rear propeller AR) and from the rear flow (generated by the rear propeller AR toward the front propeller AV) have different moduli. Consequently, the combined flow is inclined with respect to the x axis and globally has symmetry of revolution about the x axis. The combined flow exhibits a frustoconical shape in the vicinity of the vehicle. The front flow generated by the front propeller AV being more significant than the rear flow generated by the rear propeller AR, the modulus of the force of the thrust $\overrightarrow{Fav}$ resulting from the front flow is greater than that of the thrust force $\overrightarrow{Far}$ resulting from the rear flow. The thruster generates a thrust force $\vec{F}$ whose axial component is positive. The modulus of this thrust is substantially equal to the modulus of the sum of the axial components of the thrust forces generated by the two propellers. The vehicle moves with a motion of frontward translation along the x axis. This translation modifies the relative angle of attack of the blades of the front propeller and tends to reduce the front thrust. Rapidly the forward speed equilibrates at a value such that the two thrusts are in equilibrium.

Consequently, to displace the vehicle along the x axis of the propellers toward the front AV, the thruster 3 is controlled in such a way that the front thrust force $\overrightarrow{Fav}$ resulting from the front flow exhibits an axial component of greater intensity than that of the axial component of the rear thrust force $\overrightarrow{Far}$ resulting from the rear flow generated by the rear propeller AR. Stated otherwise, to obtain a frontward displacement of the vehicle along the axial direction, the front and rear flows are de-equilibrated in such a way that the combined flow is oriented rearward. The modulus of the axial component of the flow generated by the front propeller rearward must be greater than the modulus of the axial component of the flow generated by the rear propeller frontward. To obtain this axial displacement, the combination of rotation speed/collective pitch of each propeller is adjusted so that the propellers produce a different thrust. For example, this is carried out by increasing the front collective pitch and by reducing the rear collective pitch without modifying the rotation speeds with respect to the situation of FIG. 1. It is preferable to act on the collective pitch rather than on to modify the rotation speeds of the propellers since too large a difference in vorticity of the generated flows may lead to an instability and moreover generates a roll-wise torque.

In FIG. 2, the combined flow having symmetry of revolution about the x axis, the thruster generates a thrust force $\vec{F}$ whose radial component is zero. The vehicle does not go into rotation about an axis perpendicular to the x axis in this configuration.

The displacement obtained is purely axial.

Figure 3:
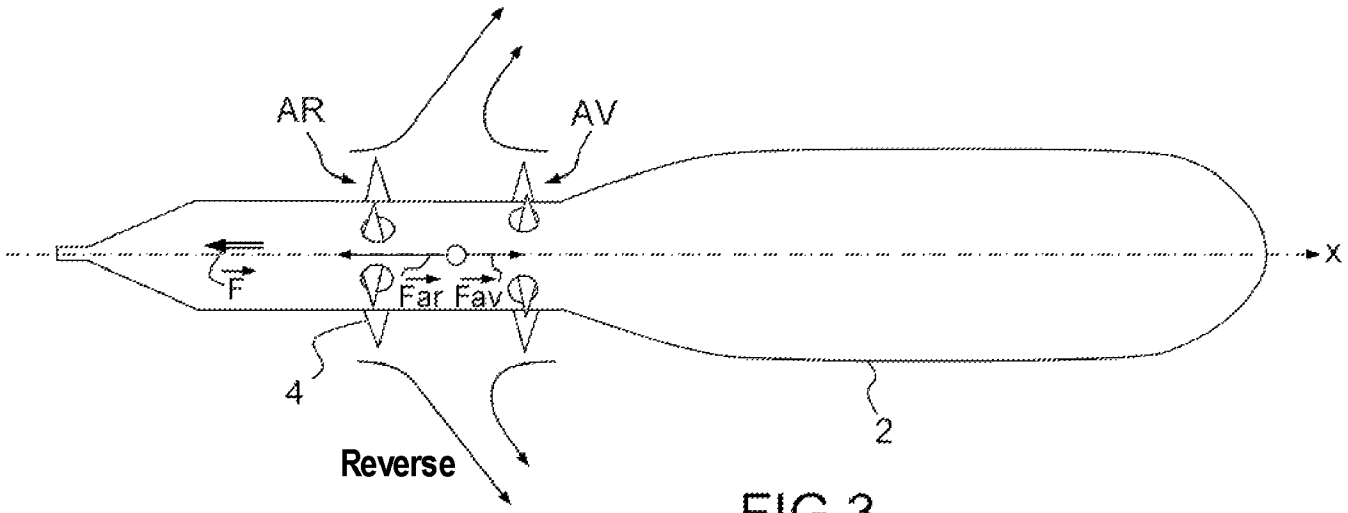

In FIG. 3, the flows generated by the two propellers are directed toward one another and along the x axis. This signifies that each of these flows has symmetry of revolution about the x axis. On the other hand, the front $\overrightarrow{Fav}$ and rear $\overrightarrow{Far}$ thrust forces resulting respectively from the front flow (generated by the front propeller AV toward the rear propeller AR) and from the rear flow (generated by the rear propeller AR toward the front propeller AV) have different moduli. Consequently, the combined flow is inclined with respect to the x axis and globally has symmetry of revolution about the x axis. The combined flow exhibits a frustoconical shape in the vicinity of the vehicle. The front flow generated by the front propeller AV being weaker than the rear flow generated by the rear propeller AR, the modulus of the force of the thrust $\overrightarrow{Fav}$ resulting from the front flow is less than that of the thrust force $\overrightarrow{Far}$ resulting from the rear flow. The thruster generates a thrust force $\vec{F}$ whose axial component is negative. The vehicle moves with a motion of rearward translation along the x axis. The vehicle reverses along the x axis. This translation modifies the angle of attack of the blades of the rear propeller and tends to reduce the rear thrust. Rapidly the reverse speed equilibrates at a value such that the two thrusts are in equilibrium.

Consequently, to displace the vehicle along the x axis of the propellers rearward, the thruster 3 is controlled in such a way that the front thrust force $\overrightarrow{Fav}$ resulting from the front flow generated by the front propeller AV exhibits an axial component of lower intensity than that of the axial component of the rear thrust force $\overrightarrow{Far}$ resulting from the rear flow generated by the rear propeller AR. Stated otherwise, to obtain a displacement of the vehicle along the axial direction rearward, the front and rear flows are de-equilibrated in such a way that the combined flow is oriented frontward. The modulus of the axial component of the flow generated by the front propeller must be less than the modulus of the axial component of the flow generated by the rear propeller rearward. To obtain this configuration, it is possible to make the two propellers of FIG. 1 turn at the same rotation speed with neutral cyclic pitches and with combinations of rotation speed and of collective pitches that are chosen so that the rear thrust is greater than the front thrust. As in the case of FIG. 2, and for the same reasons, action on the collective pitches is favored, rather than action on the rotation speed of the propellers.

In FIG. 3, the combined flow having symmetry of revolution about the x axis, the thruster generates a thrust force $\vec{F}$ whose radial component is zero. The vehicle does not enter into rotation about an axis perpendicular to the x axis in this configuration. The pure axial displacement of FIG. 3 is obtained, while furthermore using neutral cyclic pitches.

Generally, to displace the vehicle along the x axis, in a predetermined sense, with respect to the liquid, the thruster 3 is controlled in such a way that each propeller generates a flow directed toward and reaching the flow generated by the other propeller and in such a way that the upstream thrust force resulting from the upstream flow exhibits an axial component of greater intensity than that of the axial component of the downstream thrust force resulting from the downstream flow generated by the downstream propeller. By upstream propeller is meant the propeller situated toward the front in the sense of displacement of the vehicle along the x axis and the downstream propeller, the propeller situated toward the rear in the sense of displacement of the vehicle along the x axis.

During the low-speed maneuver controlling, the controlling of the thruster may be a controlling of the propellers. When the thruster is of the type comprising two counter-rotating propellers with variable cyclic and collective pitches, to obtain an axial component of the thrust force exerted by the thruster at fixed rotation speed of the propellers, the collective pitch (collective feathering) of at least one propeller is varied so as to obtain the desired thrust. For all the motions, in the case of the counter-rotating propellers with variable cyclic and collective pitches, the rotation speed of the propellers and/or the cyclic pitch of the propellers and/or the collective pitch of the propellers are/is adjusted so as to obtain the desired thrust. If the thruster is a Gimbal thruster, the orientation of at least one propeller is adjusted so as to obtain the desired thrust. This is valid whatever thrust is desired. The configuration of the control device may be chosen as a function of a desired thrust by calibration. A prior phase of measurement of the flow or of the thrust generated by the vehicle as a function of various adjustments of the thruster makes it possible thereafter to determine the adjustments as a function of the desired thrust.

It is noted in FIGS. 2 and 3 that the vehicle moves forward or reverses, subsequent to a controlled de-equilibration of the flows of the two propellers. The method according to the invention makes it possible always to produce furthermore a radial force making it possible to maneuver the vehicle. Stated otherwise, the thruster remains maneuvering perpendicularly to the reference axis when it produces a thrust to displace the vehicle axially. When the front and rear flows are de-equilibrated along the x axis, the vehicle moves forward or reverses, with respect to the liquid while accelerating until it reaches a limit forward speed or respectively reverse speed dependent on the resulting thrust of the two thrusters (that is to say dependent on the rotation speeds, collective incidence and cyclic incidence of the two propellers). The maximum forward speed of the vehicle with respect to the liquid is the maximum speed that the limit forward speed can take. This speed is reached when the front flow directed toward the rear is at its maximum thrust and the rear flow directed toward the front is at the minimum thrust compatible with the fact that it remains directed toward the front propeller AV. Stated otherwise, the rear propeller generates a flow toward the front and this flow is not thereafter deviated toward the rear by the front propeller. Just as there exists a maximum forward speed, there exists a maximum reverse speed reached when the rear flow directed toward the front is at its maximum thrust and the front flow directed toward the rear is at the minimum thrust compatible with the fact that it remains directed toward the rear propeller AR. Stated otherwise, the rear propeller generates a flow toward the rear and this flow is not thereafter deviated toward the front by the flow generated by the rear propeller.

In other words, between the maximum reverse speed and the maximum forward speed, the two propellers generate flows which meet between the two propellers some distance from the two propellers. Outside of this interval, the flows do not meet between the two propellers.

This speed can be obtained by trials for a given vehicle, a given axis tied to the body of the vehicle and a given sense along this axis. It is conditioned by the capacity of each of the propellers to generate a more or less intense flow.

The speed of displacement of the vehicle along the x axis is a speed of displacement of the vehicle with respect to a predetermined fixed frame of reference, for example the liquid or the terrestrial frame of reference. The speed of displacement of the vehicle with respect to the liquid is the speed of the vehicle with respect to the liquid situated in the vicinity of the vehicle away from the flow generated by the thruster. Advantageously, the speed threshold up to which the low-speed control step is implemented is predetermined and fixed for a given position of the axis of the propellers with respect to the body of the vehicle and for a given sense of displacement. This threshold is chosen less than or equal to the maximum forward or reverse speed of the vehicle along this axis in this sense. This threshold is advantageously non-zero.

Stated otherwise, the low-speed controlling step is advantageously implemented only when the following speed condition is satisfied: the norm of the speed of the vehicle along the x axis is less than or equal to a first predetermined threshold speed which is less than or equal to a maximum reverse speed, when the vehicle is moving rearward along the x axis, and the norm of the speed of the vehicle along the x axis is less than or equal to a second threshold speed which is less than or equal to a maximum forward speed when the vehicle is moving frontward along the x axis. In other words, the step of low-speed maneuver controlling is implemented only when the flows generated by the two propellers meet between the two propellers some distance from the two propellers. This makes it possible to avoid energy losses at high speed and makes it possible to ensure good maneuverability of the vehicle at low speed. The condition of meeting point situated between the two propellers defines limit forward and reverse speeds along the x axis.

Advantageously, the step of low-speed maneuver controlling is implemented as long as the speed condition is satisfied. Stated otherwise, the step of low-speed maneuver controlling is implemented whatever the motion of the vehicle on condition that the flows generated by the two propellers meet between the two propellers some distance from the two propellers. This makes it possible to guarantee good maneuverability of the vehicle in this speed interval.

The method advantageously comprises a verification step for verifying whether the speed condition is satisfied and if yes, the low-speed maneuver step is implemented. The verification step can be implemented in an iterative manner and the low-speed maneuver step is implemented as long as the speed condition is satisfied.

Figure 4:
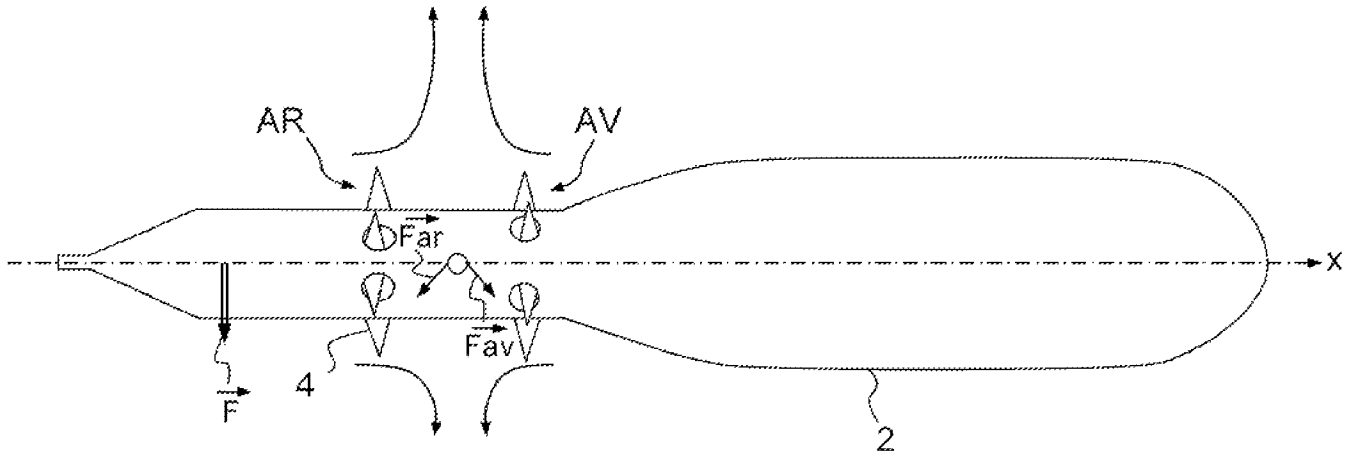

In FIG. 4, the flows generated by the two propellers are directed toward one another but are not directed along the x axis. Stated otherwise, the principal axis of flow generated by each propeller is not parallel to the x axis. Indeed, these flows do not have symmetry of revolution about the x axis. The flow generated to port is greater than the flow generated to starboard for each of the propellers thereby deviating the principal axis of the flow generated by each of these propellers with respect to the x axis. On the other hand, the axial components of the front $\overrightarrow{Fav}$ and rear $\overrightarrow{Far}$ thrust forces resulting respectively from the front flow (generated by the front propeller toward the rear propeller) and from the rear flow (generated by the rear propeller toward the front propeller) have the same intensity. Consequently, the combined flow is principally perpendicular to the x axis, and is so around the whole of the x axis. The thruster generates a thrust force $\vec{F}$ whose axial component is zero. The position of the vehicle 1 in translation along the axial direction x with respect to a terrestrial frame of reference is fixed. On the other hand, the combined flow does not have symmetry of revolution about the x axis, since the flows generated by the two propellers do not have symmetry of revolution about the two propellers. The combined flow exhibits globally the form of an asymmetric annulus exhibiting a lower flowrate to starboard than to port in the example of FIG. 4. The thruster generates a thrust force $\vec{F}$ exhibiting a non-zero radial component thereby making it possible to orient the vehicle by rotation about an axis perpendicular to the x axis or to displace the vehicle along an axis perpendicular to the x axis. On the other hand, the modulus of the force of the radial component of the thrust is not the sum of the radial component thrusts of thrusts generated by the two thrusters since a non-negligible part of this thrust originates from an interaction of the flow with the vehicle.

Consequently, to exert a thrust $\vec{F}$ exhibiting a non-zero radial component, the thruster 3 is controlled in such a way that the combined flow does not have symmetry of revolution about the x axis. Stated otherwise, at least one propeller generates a flow which does not have symmetry of revolution about the x axis. Stated otherwise, the thruster is controlled in such a way that at least one propeller generates a flow whose principal direction forms a non-zero angle with the axial direction, this propeller generating a radial thrust.

To cause the ship to turn about a rotation axis perpendicular to the axis of the propellers which is the roll axis of the object and passing through the center of mass of the object, for example the yaw or pitch axis, the thruster must be adjusted in such a way that the thrust force exerted by the thruster is applied some distance from the center of mass of the vehicle. Preferably, the thrust is applied between the two propellers.

To pass from the situation represented in FIG. 1 to the situation represented in FIG. 4, the cyclic pitch of the two propellers is modified in such a way that the cyclic pitches of the two propellers are equal (same feathering angle/same cyclic angle) for identical propellers turning at the same rotation speed. In the example of FIG. 4, the cyclic angle is maximum to port for the two propellers. Stated otherwise, the thruster 3 is controlled in such a way that the propellers generate flows which do not have symmetry of revolution about the x axis but which exhibit the same intensity in respective radial angular sectors, tied to the body of the vehicle, having one and the same angular size and forming, about the x axis, one and the same angle with the reference direction. This makes it possible to obtain a maximum thrust along a given radial direction. The way to obtain this direction is described by FIG. 5 that we explain further on.

To make the vehicle move forward along the axial direction as in FIG. 2 while exerting a radial force as in FIG. 4, it is possible to modify the collective pitch of at least one of the propellers thereof with respect to the configuration of FIG. 4 so as to generate a thrust $\vec{F}$ exhibiting a non-zero axial component.

To displace the vehicle in translation along an axis perpendicular to the reference axis, for example along the yaw or pitch axis, the thruster must be controlled so as to generate a radial thrust applied to the center of mass of the object. For example, the cyclic pitch of the front propeller is more significant than that of the rear propeller and the propeller angle is arbitrary. Advantageously, a differential cyclic feathering angle of cyclic angle of opposite sign to the other propeller is used. Thus, it is possible to shift the point of application of the force beyond the segment formed by the centers of the two propellers. If the point of application is shifted until it coincides with the center of gravity of the vehicle, the method makes it possible to obtain a pure lateral displacement.

To obtain a rotation of the vehicle about the x axis in the situation of FIG. 1, the rotation speeds of the propellers about the rotation axis are controlled so as to generate a non-zero rotation torque about the x axis.

The step of low-speed maneuver controlling can be implemented during the realization of at least one of the motions described hereinabove, for example when the modulus of the vehicle speed with respect to a predetermined frame of reference (for example terrestrial or the liquid) along the axis of the propellers is less than a predetermined threshold. As a variant, the low-speed controlling step can be implemented permanently during the realization of all the motions described hereinabove when the modulus of the speed is less than the speed threshold. The low-speed controlling step according to the invention may be implemented only when the speed of the vehicle is less than the predetermined threshold or even when the vehicle exhibits a value greater than this threshold. In the latter case it will lead to rapid braking of the vehicle which will stabilize at the speed corresponding to the adjustment of the propellers, such as described when analyzing FIG. 2.

Figure 5:
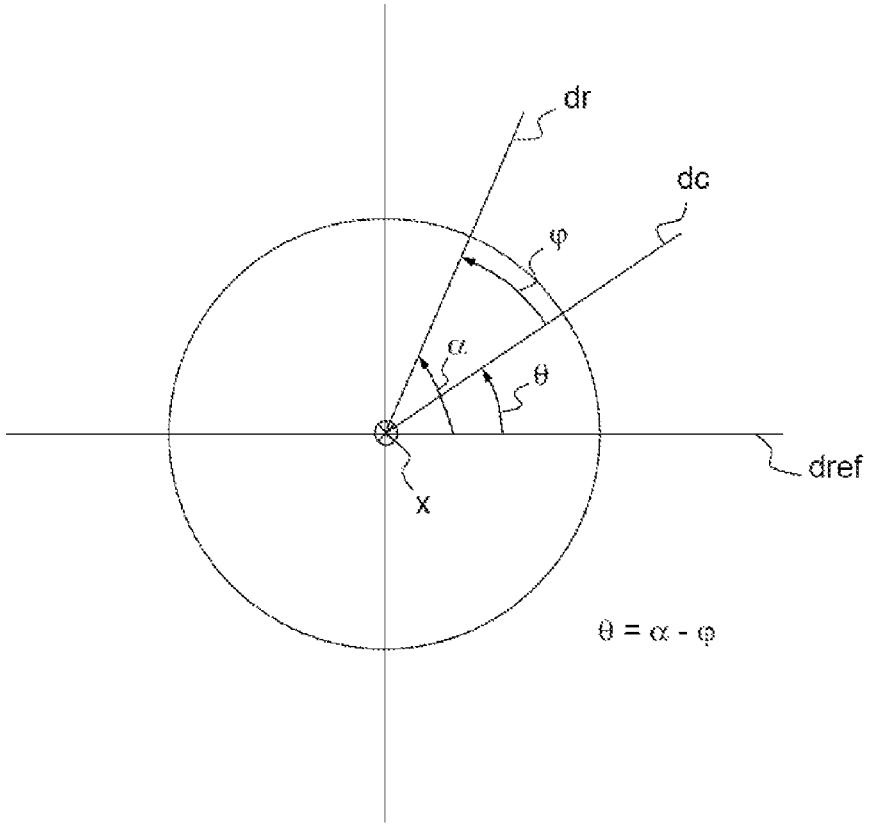
FIG. 5 represents schematically, in a radial plane, the direction of the thrust exerted by the thruster as a function of the cyclic angle, FIG. 6 schematically represents a propulsion system according to the invention.

We shall now describe, with reference to FIG. 5, a particular step for adjusting the thruster so as to obtain a radial thrust according to a predetermined radial direction dr forming, about the reference axis, a predetermined so-called angle of thrust $\alpha$ with a reference direction dref, in a reference frame tied to the body of the vehicle. The thrust generated by the thruster can also comprise an axial thrust. This step is advantageously implemented when the axes of the two propellers coincide with the reference axis.

The angle of thrust is different from the cyclic angle of the propellers. The radial thrust generated by the thruster is directed along a radial direction dr forming, about the reference axis, an angle called cyclic phase $\varphi$ with the direction dc along which the cyclic feathering angles of the propellers are maximal. This cyclic phase $\varphi$ is, by symmetry, independent of the direction of the radial thrust generated by the thruster.

To obtain the desired radial thrust, the cyclic pitches of the propellers are adjusted in such a way that their cyclic angles $\theta$ are given by the following formula or that the cyclic angle of one of the two propellers is given by the following formula, the other propeller exhibiting a neutral cyclic pitch:

$$\theta=\alpha-\varphi$$

The corrected radial direction dc, according to which the cyclic feathering angle of the blades is maximal, forms about the reference axis, an angle $\theta$ with the reference direction dref.

The cyclic phase $\varphi$ is advantageously determined during a prior calibration step. This calibration step comprises a measurement step comprising a first step of measuring forces and torques exerted by the vehicle on a test bench secured to the vehicle for several cyclic pitches of one or more propellers and/or a second step of measuring the direction of the motion of the vehicle submerged in the liquid in a cleared zone for several cyclic pitches of one or more propellers by means of gyrometers and accelerometers of the direction of the motion of the underwater vehicle as a function of the cyclic pitch of the propellers. The calibration step furthermore comprises a step of calculating the cyclic phase on the basis of measurements carried out during the measurement step.

Advantageously, the distance between the propellers, that is to say between the centers of the propellers, lies between a non-zero threshold value and triple the diameter D of the larger of the two propellers. This limited distance between the propellers makes it possible to ensure convergence of the flows and interaction between them. The distance between the propellers does not depend on the length of the vehicle. The limited distance between the propellers makes it possible to obtain flows which converge between the propellers whatever the length of the vehicle. Thus the energy efficiency is high. The thrust generated by the thruster is the sum of the thrusts generated by the two propellers and of a force resulting from the interaction between the flows and the body of the vehicle. The interaction between the flows and the body of the vehicle generates, when at least one of the flows does not have symmetry of revolution about the x axis, a pressure field between the two propellers which is not homogeneous over the revolution about the x axis. This pressure gradient generates a lateral thrust which adds to the thrusts generated by the thrusters. The small distance between the propellers makes it possible to maximize this force and the energy efficiency of the method. An advantage afforded is effectiveness of the radial thrust phenomenon (if the propellers are too far apart, the flows will lose kinetic energy from here to the meeting point). The outflow from each propeller is disturbed by its environment. The condition of distance between the propellers therefore allows effective control of the location of the meeting point of the two opposite flows (if the propellers are too far apart, the location of the meeting point is too approximate; if the propellers are too close, the two flows will disturb one another at the level of the blades).

Advantageously, the threshold distance is greater than or equal to 20% of the diameter D of the smaller of the two propellers. Below this threshold, the interaction between the two propellers is too disturbed.

Figure 6:
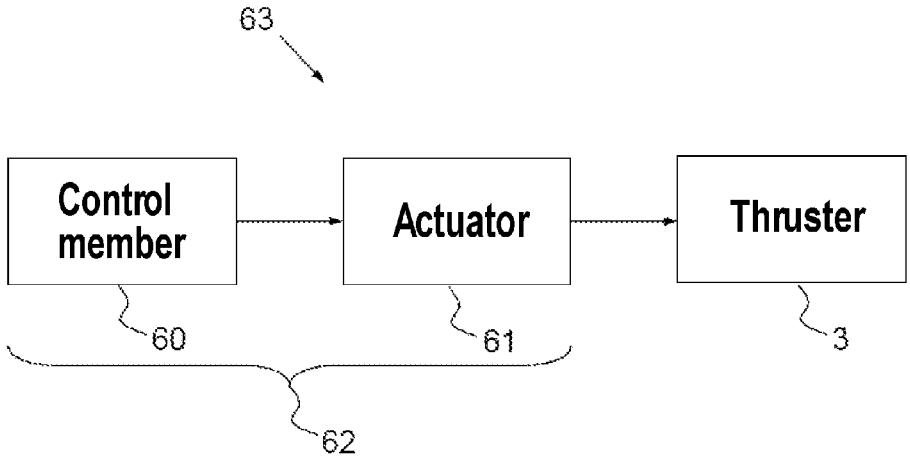

The invention also pertains to a marine vehicle 2 such as described previously comprising a propulsion system 63 such as represented in FIG. 6. The propulsion system 63 comprises a controlling or control device 62 configured to be able to implement the method according to the invention and also the thruster according to the invention. The invention also pertains to the propulsion system and to the control device.

The controlling or control device 62 comprises a control member 60 which receiving a setting for implementing the step of low-speed maneuver controlling is configured to calculate a low-speed configuration in which the thruster must be placed so that each propeller generates a flow directed toward the flow generated by the other propeller taken from among the two propellers and reaching the flow generated by the other propeller.

Advantageously, each propeller generates a non-zero flow directed essentially in the same sense over the entire revolution of the blades of the propeller in the liquid about the rotation axis of the propeller, and in such a way that each propeller taken from among the two propellers generates a flow.

The control member comprises for example an analog calculation member such as an operational amplifier mounted as weighted summator, or a programmable logic component or a processor and an associated memory containing a program configured to determine the configuration. The processor and the memory may be grouped together within one and the same component often called a microcontroller.

The control device 62 furthermore comprises an actuation device or actuator 61 configured to control the thruster so as to place it in said calculated low-speed configuration, when it receives said low-speed configuration in the form of a command which is dispatched to it by the control member.

The actuator can comprise rams, for example electric or hydraulic, or a motor actuating cables or chains and making it possible to displace the point on which they apply their force or else by rack principle. The actuator is configured to incline and/or displace the cyclic and collective swashplates.

Advantageously, the setting for implementing the step of low-speed maneuver controlling comprises a thrust setting, the thruster calculating a low-speed configuration of the thruster such that the thruster generates a desired thrust, notably a thrust in the direction of the thrust setting.

When the thruster is a thruster of the type with two counter-rotating propellers with variable cyclic and collective pitches, the configuration obtained comprises a collective pitch, a cyclic pitch and optionally a rotation speed of each propeller and the actuator(s) make it possible to adjust the collective and cyclic pitches of the two propellers. The configuration is a configuration of the propellers and the actuation device makes it possible to configure the propellers. This entails for example a magnetic device or a motorized device making it possible to adjust the cyclic and collective pitches. In a nonlimiting manner, this device comprises cyclic and collective swashplates. In the case of a thruster comprising two Gimbal thrusters, the configuration comprises the orientations of the rotation axes of the propellers. The actuation device makes it possible to actuate the Gimbal joints so as to modify the orientations of the rotation axes of the propellers.

The setting can be generated on board the vehicle (autonomous vehicle) or outside the vehicle (remotely controlled vehicle).

The invention claimed is:

1. A method for controlling a thruster of a marine vehicle at least partially submerged in a liquid comprising a body and the thruster, the thruster comprising two propellers, each propeller comprising blades intended to turn about a rotation axis of said propeller, the method comprising:

maneuver controlling, during which the thruster is controlled in such a way that each propeller generates a flow directed toward the flow generated by the other propeller and reaching the flow generated by the other propeller, and wherein the distance between the propellers lies between a non-zero threshold distance and triple the diameter of a larger of the two propellers.

2. The method of controlling as claimed in claim 1, in which each propeller generates a non-zero flow which is directed in the same sense, along the rotation axis of the propeller, over a whole revolution of the blades of the propeller in the liquid about the rotation axis of the propeller.

3. The method of controlling as claimed in claim 1, in which at least one propeller generates a flow whose sense, along the x axis, varies over the revolution of the blades of the propeller in the liquid about the rotation axis of the propeller.

4. The method of controlling as claimed in claim 1, in which the distance between the propellers is greater than or equal to 20% of the diameter of a smaller of the two propellers.

5. The method of controlling as claimed in claim 1, in which maneuver controlling is implemented only when the flows generated by the two propellers meet between the two propellers some distance from the two propellers.

6. The method of controlling as claimed in claim 1, in which maneuver controlling is implemented whatever the motion of the vehicle on condition that the flows generated by the two propellers meet between the two propellers some distance from the two propellers.

7. The method of controlling as claimed in claim 1, in which the two propellers comprise an upstream propeller and a downstream propeller along a reference axis in a predetermined sense, and in which during maneuver controlling, in order that the thruster exerts a non-zero thrust along the reference axis and in said sense, the thruster is controlled in such a way that the upstream thrust force resulting from the upstream flow generated by the upstream propeller exhibits an axial component of greater intensity than that of the axial component of the downstream thrust force resulting from the downstream flow generated by the downstream propeller.

8. The method of controlling as claimed in claim 1, in which, during maneuver controlling, in order that the thruster generates a thrust force exhibiting a zero radial component along a radial axis lying in a plane perpendicular to a reference axis, the thruster is controlled in such a way that the combined flow resulting from the combination of the flows generated by the two propellers, between the two propellers, has symmetry of revolution about the reference axis.

9. The method of controlling as claimed in claim 1, in which, during maneuver controlling, in order that the thruster exerts a thrust exhibiting a non-zero radial component along a radial axis lying in a plane perpendicular to a reference axis, the thruster is controlled in such a way that the combined flow resulting from the combination of the flows generated by the two propellers between the two propellers does not have symmetry of revolution about the reference axis.

10. The method as claimed in claim 9, in which, during maneuver controlling, in order that the vehicle turns about an axis perpendicular to the reference axis, the thruster is controlled in such a way that the thrust force generated by the thruster is applied at a point remote from the center of mass of the vehicle.

11. The method as claimed in claim 10, in which, during maneuver controlling, in order that the vehicle translates along an axis perpendicular to the reference axis, the thruster is controlled in such a way that the thrust force generated by the thruster is applied at the center of mass of the vehicle.

12. The method of controlling as claimed in claim 1, in which during maneuver controlling, in order that the thruster exerts a thrust exhibiting a non-zero radial component, the thruster is controlled in such a way that at least one propeller generates a flow which does not have symmetry of revolution about the reference axis.

13. The method of controlling as claimed in claim 1, in which the thruster is a thruster comprising two variable collective and cyclic pitch counter-rotating propellers, a reference axis being an axis joining centers of the two propellers which are points lying on the rotation axes of the respective propellers.

14. The method of controlling as claimed in claim 1, in which the rotation axes of the two propellers coincide substantially with the reference axis.

15. A control device to control a thruster of a marine vehicle at least partially submerged in a liquid comprising a body and the thruster the thruster comprising two propellers, each propeller comprising blades intended to turn about a rotation axis of said propeller, the control device being configured to implement a method comprising maneuver controlling, during which the thruster is controlled in such a way that each propeller generates a flow directed toward the flow generated by the other propeller and reaching the flow generated by the other propeller, wherein the control device comprises:

a control member which, when receiving a setting for implementing maneuver controlling, is configured to calculate a configuration in which the thruster must be placed in order that each propeller generates a flow directed toward the flow generated by the other propeller and reaching the flow generated by the other propeller, and an actuator configured to control the thruster so as to place it in said configuration, wherein a distance between the two propellers lies between a non-zero threshold distance and triple the maximum diameter of the propellers.

16. The control device as claimed in claim 15, in which the setting for implementing maneuver controlling comprises a thrust setting, the thruster calculating a the configuration of the thruster such that the thruster generates a thrust in the direction of the thrust setting.

17. A propulsion system comprising a control device as claimed in claim 15 and the thruster.

18. A marine vehicle intended to be at least partially submerged in a liquid comprising a body, and a propulsion system as claimed in claim 17.

* * * * *